US005791067A

United States Patent [19]

Bendtsen

[11] Patent Number: 5,791,067

[45] Date of Patent: Aug. 11, 1998

[54] SELF-CLEANING DOCTOR AND METHOD FOR USING ON WEB DRYER CANS

[75] Inventor: Lee A. Bendtsen, Gladstone, Mich.

[73] Assignee: The Mead Corporation, Dayton, Ohio

[21] Appl. No.: 786,825

[22] Filed: Jan. 21, 1997

[51] Int. Cl.[6] ..... D21F 5/00

[52] U.S. Cl. ..... 34/425; 34/120; 15/256.51

[58] Field of Search ..... 34/117, 118, 119, 34/120, 418, 68, 443, 498, 516, 517, 419, 425; 162/199, 272, 281; 15/256.51

[56] References Cited

U.S. PATENT DOCUMENTS

| | | | |
|---|---|---|---|
| Re. 30,924 | 5/1982 | Katayama et al. | 15/256.51 |
| 2,732,773 | 1/1956 | Smith | 92/74 |
| 2,972,767 | 2/1961 | Smith | 15/256.5 |
| 3,065,486 | 11/1962 | Scott | 15/256.51 |
| 3,507,745 | 4/1970 | Fuerst | 162/281 |
| 4,735,688 | 4/1988 | Schwab et al. | 162/272 |
| 4,906,335 | 3/1990 | Goodnow et al. | 15/256.51 X |
| 5,021,124 | 6/1991 | Turtinen et al. | 162/199 |

*Primary Examiner*—Henry A. Bennett
*Assistant Examiner*—Steve Gravini
*Attorney, Agent, or Firm*—Thompson Hine & Flory LLP

[57] ABSTRACT

A self-cleaning doctor for use with a papermachine or other paper processing machines and a method for using, wherein the doctor includes a doctor blade which is mounted on a shaft for rotation between a loaded position in which the blade is in contact with a surface that it doctors and an unloaded position in which the doctor blade is removed from the surface. The blade is oriented substantially vertically downward away from the surface when the doctor is in its unloaded position. Rotation of the doctor between its loaded and unloaded positions causes waste paper or the like that deposits or collects on the doctor to fall off the doctor into the papermachine basement.

13 Claims, 4 Drawing Sheets

SELF-CLEANING DOCTOR AND METHOD FOR USING ON WEB DRYER CANS

BACKGROUND OF THE INVENTION

The present invention relates to doctors for top-felted papermachine dryers and other paper processing machines and, more particularly, to a self-cleaning doctor and method for using the doctor with top-felted papermachine dryers.

Papermachines and other paper processing machines, such as coaters, employ dryer cans. The dryer cans are internally heated such that as the paper web passes over the dryer cans the water remaining in the paper web evaporates. The paper web is held in contact with the dryer cans by felt or other fabrics under tension. The dryer cans must remain free of debris to operate efficiently and effectively. Doctors are conventionally employed to clean debris from the dryer cans. Doctors incorporate a doctor blade which is pressed against the dryer can to scrape and remove debris lodged on the dryer can.

In many applications the doctors are not pressed against the dryer can continuously during the paper manufacture as the removed debris can then become airborn and possibly become deposited on the paper web causing defects. Rather the doctors are loaded, either manually or automatically, at a time when the paper is normally culled (e.g. during reel changes) or during web breaks.

In paper processing machines that utilize top-felted configurations, one or more of the top dryer cans will often be wrapped with waste paper after a web break. A doctor is then loaded against the dryer can to remove the paper wrap. However, the removed wrap jams between the doctor and the dryer can creating a paper plug. Removing the plug has conventionally been a costly and onerous task.

Doctors rotate to move their associated blades between a loaded position in which their blades are in contact with a surface of a dryer can and an unloaded position in which their blades are removed from the surface of the dryer can. For conventional doctors that have a short, limited rotation for their blades, approximately 10° to 20° between their loaded and unloaded positions, it is extremely difficult to clean the waste paper and paper debris from the doctors. Cleaning the waste paper from the conventional doctors requires time to stop the dryer section, removal of the waste paper by some manual method, usually a long pole with a hook on it, and time to return the dryer section to its original speed. The wear and tear on operational and mechanical components of the papermachines, for example, brakes, clutches, motors, etc., is proportional to the number of times the dryer cans are stopped and restarted. Therefore, the act of stopping and restarting the dryer cans is costly in time and money.

Accordingly, there is a need for a self-cleaning doctor for use with top-felted papermachine dryers that is capable of rotating sufficiently to permit waste paper that has accumulated under the doctor blade to be readily removed while the papermachine is in operation.

SUMMARY OF THE INVENTION

The present invention is a self-cleaning doctor for use with top-felted papermachines and other top-felted paper processing machines, such as coaters, and a method for cleaning the doctor that significantly reduces the amount of time required to effectively clean the doctor.

The self-cleaning doctor of the present invention is capable of rotating its doctor blade such that the doctor blade is oriented substantially vertically downward. Such rotation permits collected waste paper to fall off the doctor and doctor blade into the papermachine basement without manual cleaning of the doctor by an operator.

It has been found that by employing the self-cleaning doctor of the present invention into top-felted papermachines or other paper processing machines, the problems associated with conventional doctors are alleviated.

Furthermore, the self-cleaning doctor is capable of rotating its blade and, thus cleaning itself while the papermachine is in operation.

Accordingly, it is an object of the present invention to provide a self-cleaning doctor for use with top-felted papermachines or other paper processing machines; to provide a self-cleaning doctor that can be cleaned while the papermachine is in operation; and to provide a method for using the self-cleaning doctor with top-felted papermachines.

DETAILED DESCRIPTION

The term "paper processing machine" means any machine for processing a paper web including paper coating machines, paper printing presses, etc.

For purposes of this description, a top-felted papermachine will be used, however, the self-cleaning doctor and method of the present invention are capable of being used generally in any paper processing machine that incorporates a top-felted configuration.

Figure 1:
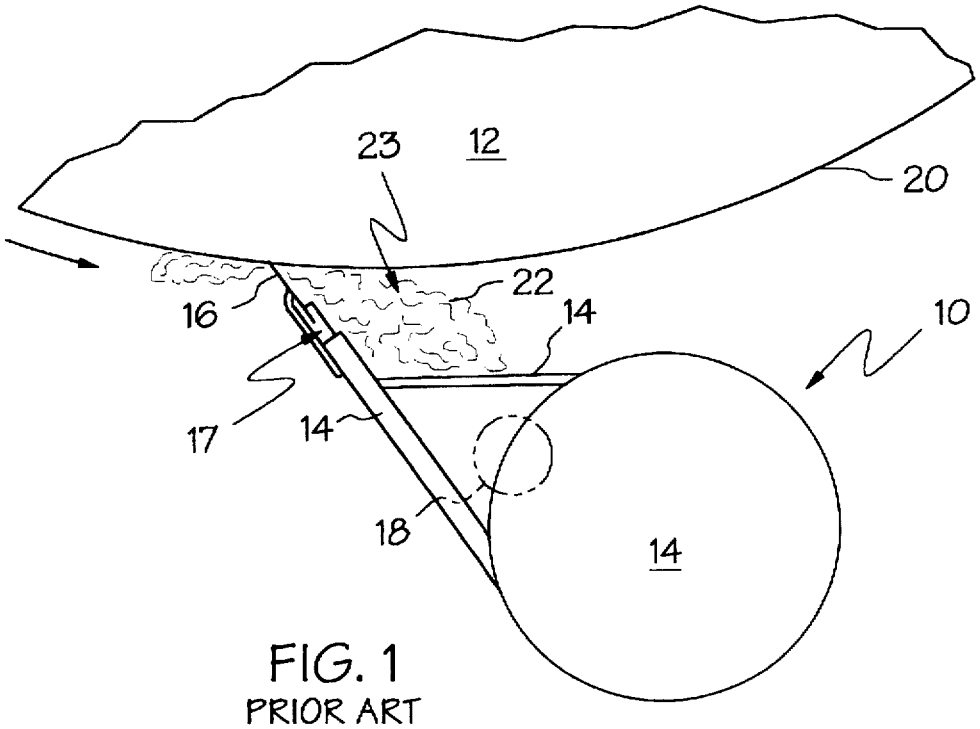
FIG. 1 PRIOR ART
FIG. 1 is a schematic view of a prior art doctor shown in a loaded position with a partial section of a top-felted papermachine dryer can.
Figure 2:
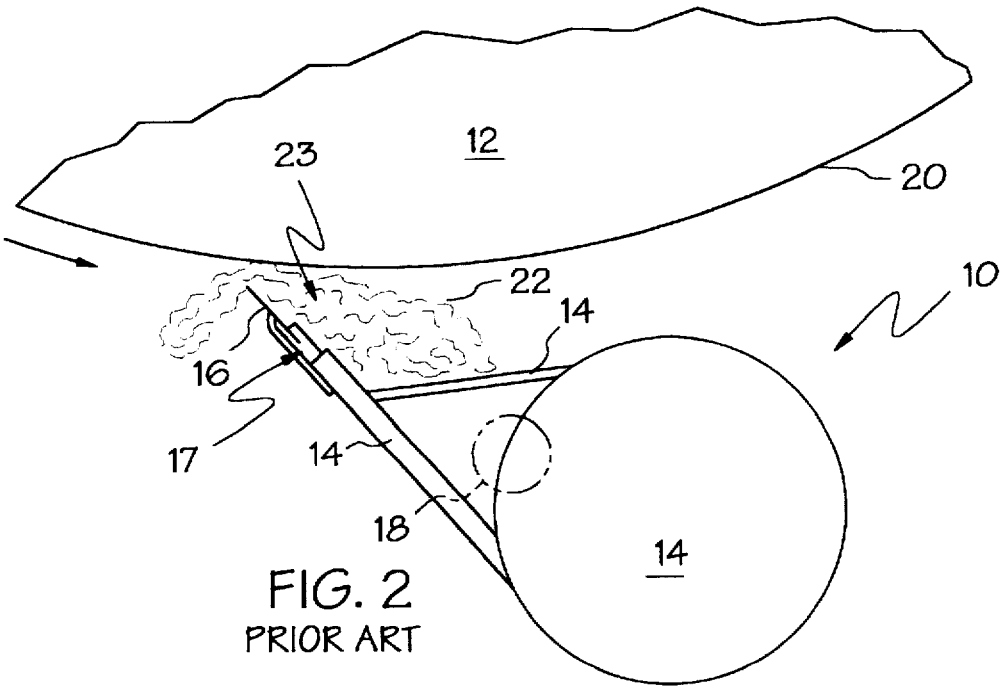
FIG. 2 PRIOR ART
FIG. 2 is a schematic view of the prior art doctor of FIG. 1 shown in an unloaded position with a partial section of a top-felted papermachine dryer can.

As shown in FIGS. 1 and 2, a partial section of a top-felted papermachine (not shown) includes a prior art doctor, generally designated 10, and a dryer can 12. The prior art doctor 10 includes a doctor body 14 having a doctor blade 16 which is mounted on the doctor body 14 by a blade holder 17. The doctor body 14 is mounted on a shaft 18 around which the doctor 10 rotates between a loaded position (shown in FIG. 1) in which the working edge 29 of the blade 16 is in contact with a surface 20 of the dryer can 12 and an unloaded position (shown in FIG. 2) in which the blade 16 is removed from the surface 20 of the dryer can 12.

In operation, the prior art doctor 10 loads when a web break is detected. The loading of the doctor 10 is accomplished by the doctor body 14 being manually or automatically rotated around the shaft 18 such that the working edge 15 of the doctor blade 16 is in contact with the surface 20 of the dryer can 12 to scrape and remove any paper that has wrapped around the dryer can 12 as a result of the web break. The removal of waste paper from the surface 20 of the dryer can 12 produces "broke" 22, some of which deposits and collects under and downstream of the doctor blade 16 in the channel, generally designated 23, between the channel 23 and the surface 20 of the dryer can 12. The channel 23 is formed by the combination of the doctor body 14, doctor blade 16 and blade holder 17.

The "broke" 22 that has collected on the doctor 10 must be removed from the doctor 10 when the doctor 10 is in its unloaded position, as shown in FIG. 2. To remove the "broke" 22, the papermachine (not shown) and the dryer can 12 must be stopped to allow an operator to manually clean the "broke" 22 from the doctor body 14 and blade 16.

Typically, the doctor blades 16 of the prior art doctors 10 of FIGS. 1–2 are only capable of rotating about 10° to 20° between their loaded and unloaded positions around the shaft 18.

Figure 3:
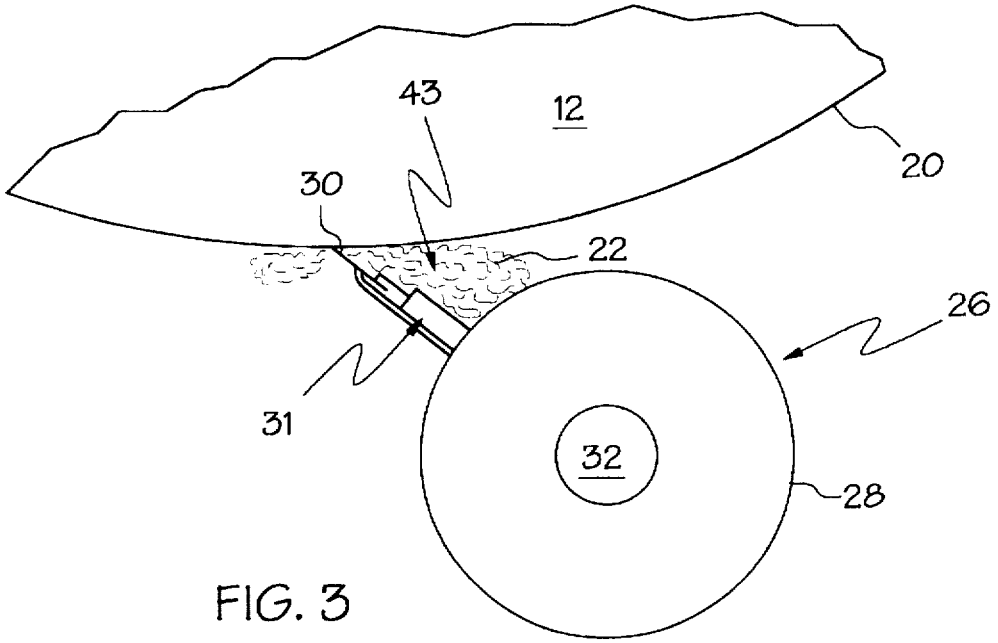
FIG. 3 is a schematic view of a preferred embodiment of a self-cleaning doctor of the present invention, shown in a loaded position with a partial section of a top-felted papermachine dryer can.

As shown in FIG. 3, in accordance with one preferred embodiment of the present invention, a partial section of a top-felted papermachine (not shown) includes a self-cleaning doctor, generally designated 26, and a dryer can 12. The self-cleaning doctor 26 includes a doctor body 28 having a doctor blade 30 with a working edge 29 which is mounted on the doctor body 28 by a blade holder 31. Any suitable doctor blade known in the art can be used with the self-cleaning doctor 26. For example, suitable doctor blades are commercially available from Essco Inc., Pacific Saw & Knife Co., Thermoelectron Inc., etc.

The doctor body 28 is mounted on a shaft 32 around which the doctor 26 rotates between a loaded position (shown in FIG. 3) in which the working edge 29 of the blade 30 is in contact with a surface 20 of the dryer can 12 and an unloaded position (shown in FIG. 4) in which the working edge 29 of the blade 30 is removed from the surface 20 of the dryer can 12. When the doctor 26 is in its unloaded position, the working edge 29 of the doctor blade 30 is oriented substantially vertically downward.

Figure 5A:
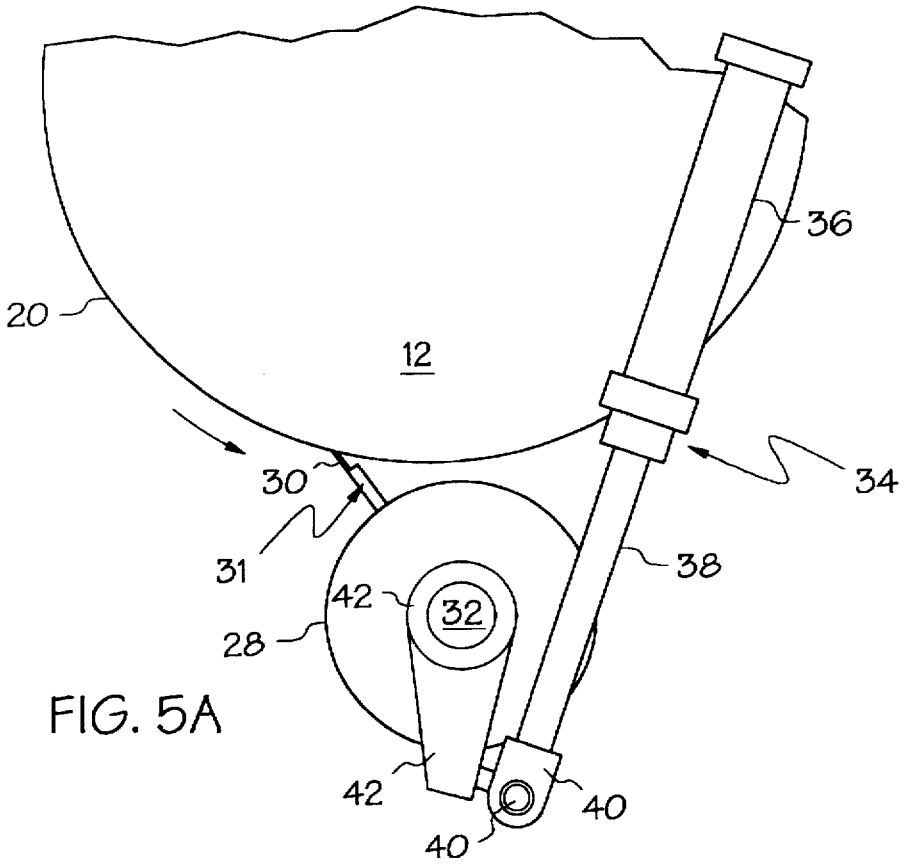
FIG. 5A is a schematic view of the self-cleaning doctor of FIG. 3 with a preferred embodiment of a rotating mechanism of the present invention.
Figure 5B:
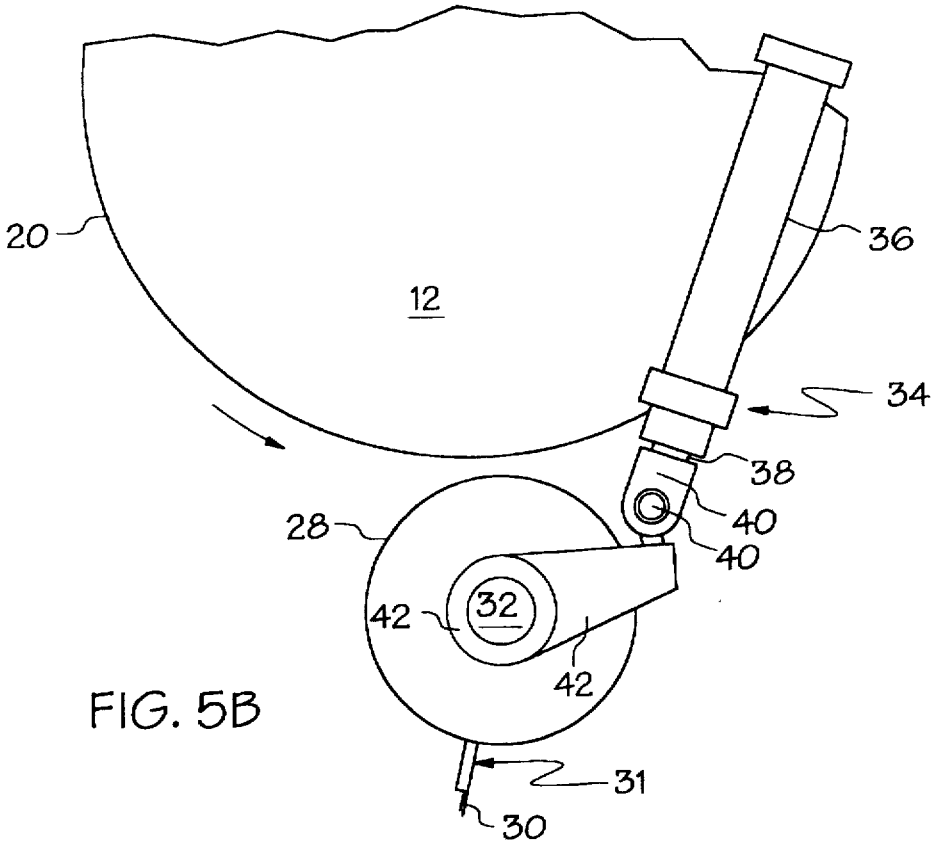
FIG. 5B is a schematic view of the self-cleaning doctor of FIG. 5A in an unloaded position.

As shown in FIGS. 5A and 5B, in accordance with one preferred embodiment of the present invention, a rotating mechanism, generally designated 34, for rotating the doctor body 28 and doctor blade 30 of the self-cleaning doctor 26 around the shaft 32 includes a pneumatic cylinder 36 having a telescopically extendable and retractable cylinder shaft 38. The cylinder shaft 38 includes a connecting means 40 which rotatably connects the cylinder shaft 38 to a shaft arm 42 extending from the shaft 32. Preferably, the connecting means is a clevis and lever arm. Those skilled in the art will appreciate that other rotating mechanisms are not outside the scope of the present invention.

The operation of the self-cleaning doctor 26, as best shown in FIGS. 5A and 5B, is as follows. A top-felted papermachine (not shown) includes a dryer can 12 and a self-cleaning doctor 26 having a rotating mechanism 34. Under normal running conditions, the pneumatic cylinder 36 is not charged and as a result, the cylinder shaft 38 is fully retracted and the self-cleaning doctor 26 is in its unloaded position as shown in FIG. 5B.

Upon detection of a web break in the paper sheet being processed, the pneumatic cylinder 36 is charged and as a result, the cylinder shaft 38 becomes fully extended and the doctor 26 is loaded as shown in FIG. 5A. The extension of the cylinder shaft 38 acts upon the shaft arm 42 by transmitting energy from the cylinder shaft 38 through the connecting means 40 to the shaft arm 42. The shaft arm 42, which is attached to the shaft 32 causes the shaft 32 to rotate the doctor body 28 and associated doctor blade 30 until the working edge 29 of the doctor blade 30 comes into contact with the surface 20 of the dryer can 12 as shown in FIG. 5A.

Figure 4:
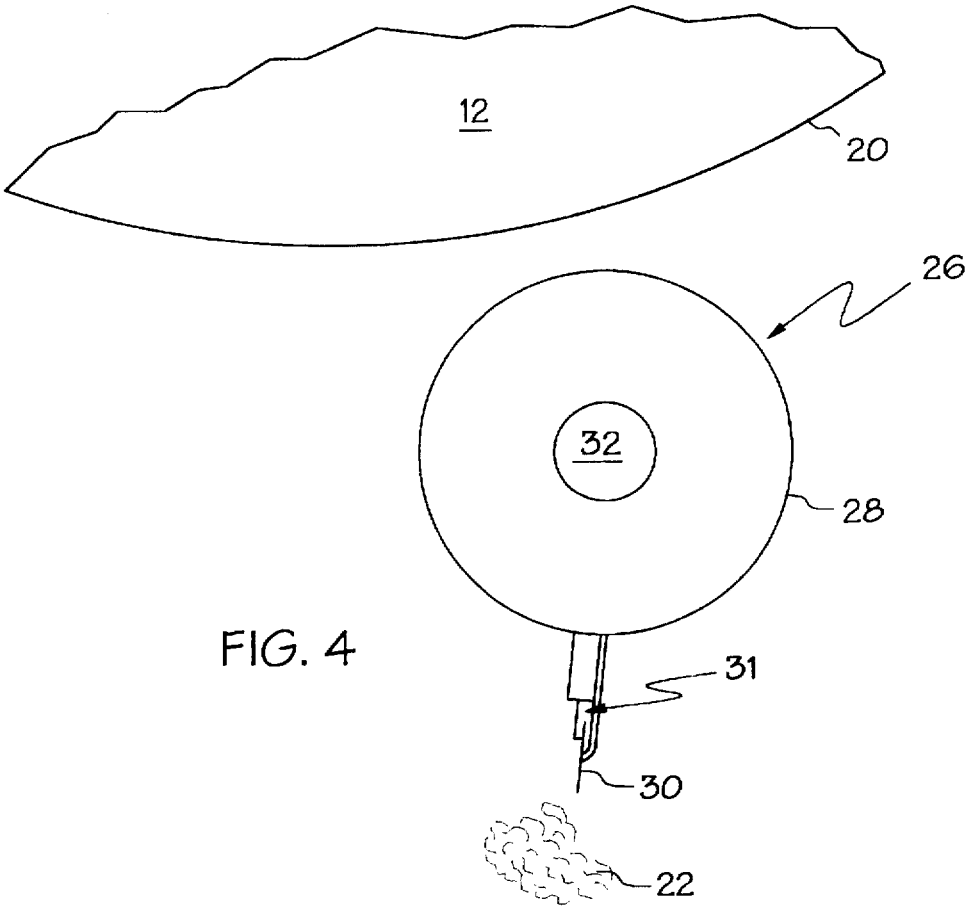
FIG. 4 is a schematic view of the self-cleaning doctor of FIG. 3 in an unloaded position with a partial section of a top-felted papermachine dryer can.

When the self-cleaning doctor 26 is loaded, as best shown in FIG. 3, after a web break has occurred, the "broke" 22 deposits and collects in a channel 43 formed by the combination of the doctor body 28, blade 30, and blade holder 31. This "broke" 22 can be cleaned from the doctor body 28 and blade 30 by actuating the pneumatic cylinder 36 to retract the cylinder shaft 38 causing the doctor body 28 and blade 30 to rotate to the doctor's 26 unloaded position and, thus remove the working edge 29 of the blade 30 from the surface 20 of the dryer can 12 as best shown in FIG. 5A. Preferably, the doctor body 28 and blade 30 are rotated such that the working edge 29 of the blade 30 is oriented substantially vertically downward as best shown in FIG. 4. When the doctor blade working edge 29 of the 30 is oriented substantially vertically downward, the "broke" 22 falls off the blade 30 into the papermachine basement. The rotation of the self-cleaning doctor 26 can occur during operation of the dryer can 12 and associated papermachine.

Under normal running conditions, the doctor 26 is in its unloaded position with the working edge 29 of its blade 30 oriented substantially vertically downward, as shown in FIG. 4.

It is desirable that the self-cleaning doctor 26 is capable of rotating its doctor blade 30 greater than about 20° between the doctor's 26 loaded and unloaded positions. Preferably, the doctor 26 is capable of rotating its doctor blade 30 from about 20° to about 120° and, more preferably approximately 120° between the doctor's 26 loaded and unloaded positions.

Those skilled in the art will appreciate that other orientations which are not substantially vertically downward are within the scope of the invention.

Figure 6A:
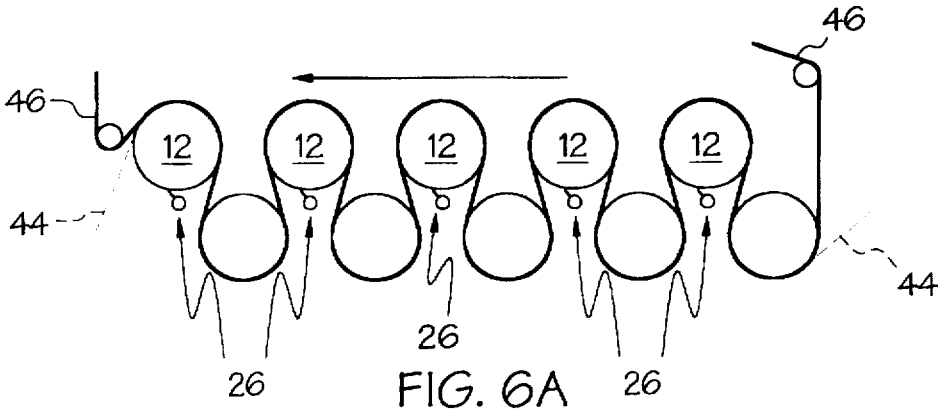
FIG. 6A is a schematic view of a preferred embodiment of a top-felted papermachine configuration employing the self-cleaning doctor of the present invention.
Figure 6B:
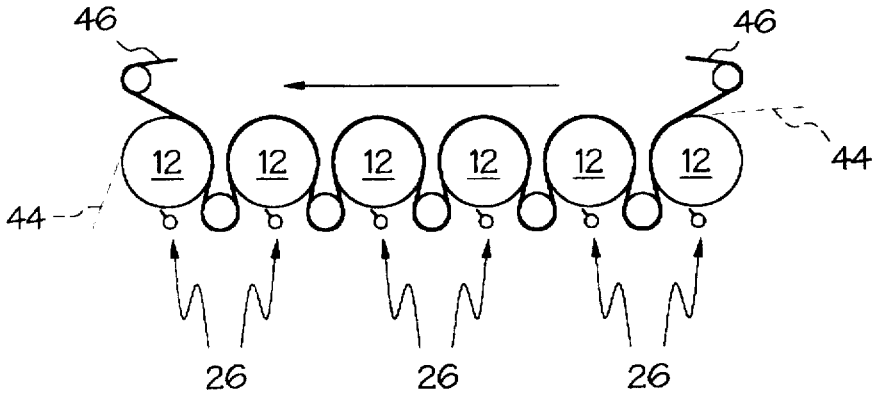
FIG. 6B is a schematic view of a first alternate embodiment of a top-felted papermachine configuration employing the self-cleaning doctor of the present invention.
Figure 6C:
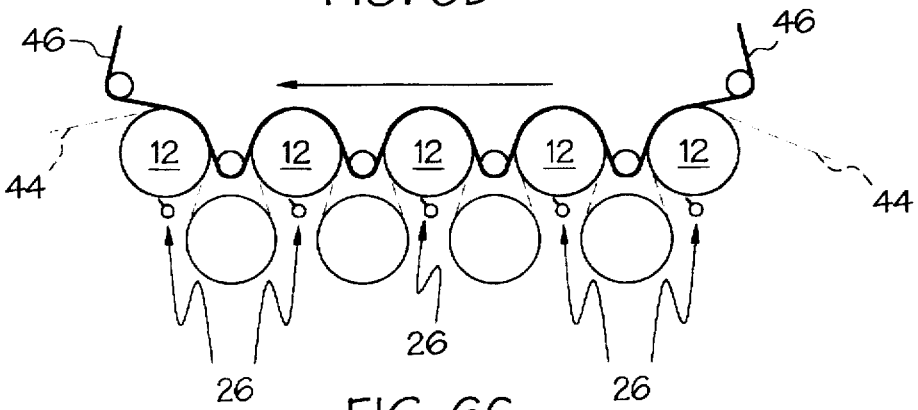
FIG. 6C is a schematic view of a second alternate embodiment of a top-felted papermachine configuration employing the self-cleaning doctor of the present invention.
Figure 6D:
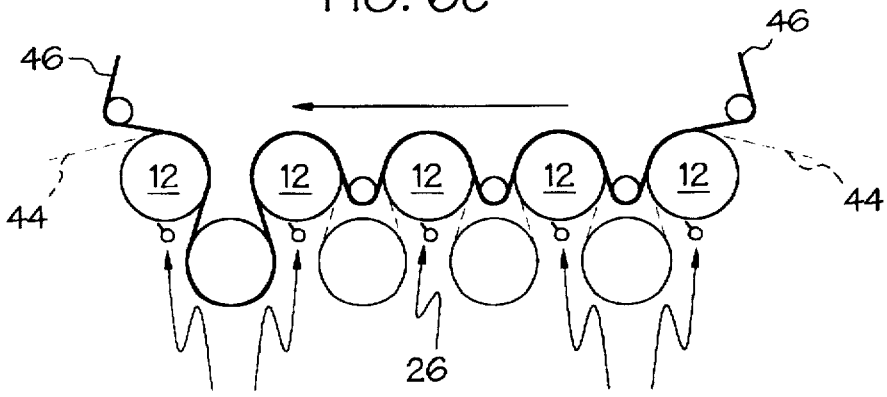
FIG. 6D is a schematic view of a third alternate embodiment of a top-felted papermachine configuration employing the self-cleaning doctor of the present invention.

As shown in FIGS. 6A–D, the self-cleaning doctor 26 of the present invention can be used with any suitable papermachine having a top-felted configuration. For example, the doctor 26 can be used with a top-felted "serpentine" or "unorun" papermachine as shown in FIG. 6A. FIG. 6B shows the use of the doctor 26 with a top-felted single tier papermachine. FIG. 6C shows the use of the doctor 26 with a single felted, top-felted only papermachine. FIG. 6D shows the use of the doctor 26 with a top-felted pistol grip papermachine. The paper web 44 is held in contact with the dryer cans 12 by felt 46. The doctors 26 clean the dryer cans 12 during operation of the papermachine. Any waste paper from the dryer cans 12 falls into the papermachine basement directly or after the doctors 26 rotate their doctor bodies 28 and blades 30 to the doctors' 26 unloaded positions, thus permitting any collected waste paper to fall off the doctors 26.

Those skilled in the art will appreciate that the self-cleaning doctor of the present invention can be used with other top-felted paper processing machines.

Having described the invention in detail, by reference to preferred embodiments thereof and by reference to the drawings, it will be apparent that modifications and variations are possible without departing from the scope of the invention defined in the appended claims.

What is claimed is:

1. A method comprising for removing broke that accumulates on a doctor while cleaning a surface wherein the doctor includes a doctor blade having a working edge, the doctor blade being mounted on a shaft for rotation between a loaded position in which the working edge of the blade is in contact with the surface that it doctors and an unloaded position in which the working edge of the doctor blade is removed from the surface, by rotating the blade such that the working edge of the doctor blade is oriented substantially vertically downward when in the unloaded position.

2. The method of claim 1 wherein the surface is a dryer can surface.

3. The method of claim 1 wherein the doctor is used in a top-felted paper processing machine.

4. The method of claim 1 wherein the blade rotates greater than 20° between the loaded and unloaded positions.

5. The method of claim 4 wherein the blade rotates about 20° to about 120° between the loaded and unloaded positions.

6. The method of claim 1 wherein the step of rotating the doctor employs a pneumatic cylinder.

7. A dryer for use in drying a paper web which comprises a dryer can and a doctor, the doctor comprises a doctor blade having a working edge, mounted on a shaft for rotation between a loaded position in which the working edge of the blade is in contact with the surface that it doctors and an unloaded position in which the working edge of the doctor blade is removed from the surface, wherein the working edge of the blade is oriented substantially vertically downward when in the unloaded position.

8. The dryer of claim 7 wherein the dryer includes a felt which runs over the top of the dryer can.

9. The dryer of claim 7 wherein the doctor includes a downstream side and the doctor is positioned below the dryer can such that broke accumulating on the downstream side of the doctor can be removed by rotating said doctor to a position in which the working edge is substantially vertically downward.

10. The dryer of claim 7 wherein the surface is a dryer can surface.

11. The dryer of claim 7 wherein the doctor is used in a top-felted paper processing machine.

12. The dryer of claim 7 wherein the blade rotates greater than 20° between the loaded and unloaded positions.

13. The dryer of claim 12 wherein the blade rotates about 20° to about 120° between the loaded and unloaded positions.

* * * * *